340-566 SR
12/17/85 OR 4,559,528

United States Patent [19]

Davis

[11] Patent Number: 4,559,528

[45] Date of Patent: Dec. 17, 1985

[54] ORNAMENTAL VIBRATION SENSOR DEVICE FOR BURGLAR ALARM SYSTEM

[75] Inventor: Jeffrey J. Davis, New Lebanon, Ohio

[73] Assignee: Don E. Berger, Dayton, Ohio ; a part interest

[21] Appl. No.: 513,703

[22] Filed: Jul. 14, 1983

[51] Int. Cl.[4] ..... G08B 13/02

[52] U.S. Cl. ..... 340/566; 340/545; 340/550; 340/693

[58] Field of Search ..... 340/545, 566, 550, 693; D10/106

[56] References Cited

U.S. PATENT DOCUMENTS

| | | | |
|---|---|---|---|
| 2,884,623 | 4/1959 | Stelter | 340/566 |
| 3,863,250 | 1/1975 | McCluskey, Jr. | 340/566 |
| 4,054,867 | 10/1977 | Owens | 340/566 |
| 4,075,614 | 2/1978 | White | 340/693 |
| 4,122,445 | 10/1978 | Orita | 340/566 |

*Primary Examiner*—Glen R. Swann, III
*Attorney, Agent, or Firm*—Jacox & Meckstroth

[57] ABSTRACT

A vibration sensor device is mounted on a translucent ornamental disc so it can be mounted at any desired position on a window pane so as to achieve the greatest sensitivity without being asthetically offensive. A bracket affixed to the disc mounts a base to which electrical leads are attached to connect the sensor to an alarm control unit. A motion sensing switch is detachably connected to the base to allow easy substitution of switches of different sensitivities. A cover hides the bracket, base, and switch and the whole unit is adhesively attached to the window pane.

1 Claim, 5 Drawing Figures

ORNAMENTAL VIBRATION SENSOR DEVICE FOR BURGLAR ALARM SYSTEM

BACKGROUND OF THE INVENTION

Several types of burglar alarm systems include a vibration or motion sensor device which is attached to a window pane in a building which is protected by the alarm system. The vibration or motion sensor device senses vibration or motion in a portion of the window pane when the window pane is broken or moved. The vibration or motion sensor conventionally is of the inertial type which includes a normally-closed switch which opens when subjected to sudden motion or vibration. The switch is electrically connected to an alarm system. Therefore, when the switch is opened an audible and/or visible alarm signal in the alarm system is actuated.

Conventionally, a vibration or motion sensor device in a burglar alarm system has been enclosed within a box-like housing which is attached to a window pane. The box-like housing is unattractive and is therefore ordinarily positioned in a most obscure location adjacent the edge and/or corner of the window pane. A vibration or motion sensor device which is positioned adjacent an edge and/or corner of a window pane is located in a position in which the sensor device is least sensitive with respect to the entire window pane and may not be capable of sensing window pane vibration or motion which is created by an experienced burglar.

It is an object of this invention to provide a window pane vibration or motion sensor device which is adapted to be attached to the central portion of a window pane so that the sensor device is located in a position of maximum vibration sensitivity.

It is another object of this invention to provide such a sensing device which has an attractive, pleasing appearance.

Another object of this invention is to provide such a window pane vibration sensor device which can be produced at relatively low costs.

Other objects and advantages of this invention reside in the construction of parts, the combination thereof, the method of production, and the mode of operation, as will become more apparent from the following description.

SUMMARY OF THE INVENTION

An ornamental vibration sensor device of this invention comprises a disc, which may be round or of any other suitable or desired shape. The disc is preferably translucent and has attractive colors which are applied by stains or paints, or the like. The disc is adapted to be secured to any portion of a window pane, preferably adjacent the central region of the window pane, so that sunlight flows through the disc. An electric switch of the inertial type is secured to the disc. Electric conductors extend from the electric switch to another portion of a burglar alarm system. The electric switch is adapted to sense vibration or sudden movement and to transmit through the electric conductors a signal in response to such vibrations or sudden movement.

DETAILED DESCRIPTION OF THE INVENTION

Figure 1:
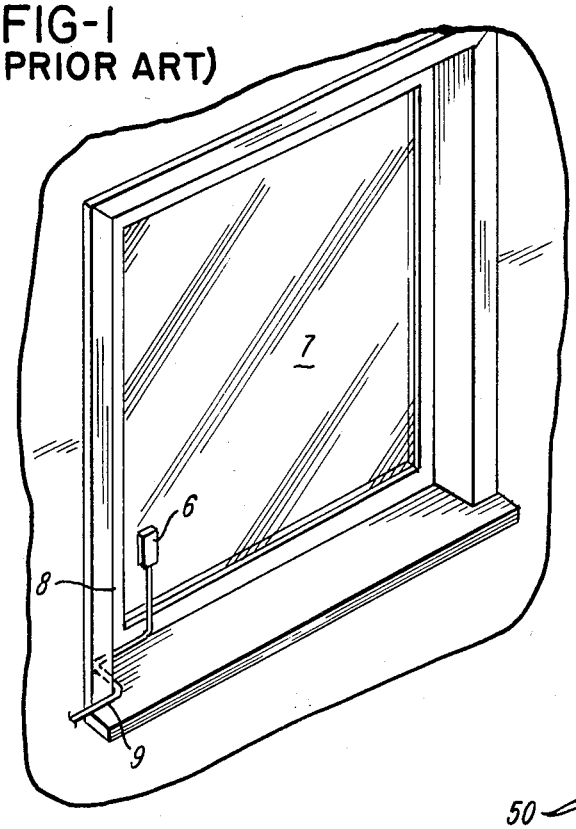
FIG-1 (PRIOR ART)
FIG. 1 is a perspective view of a window and window pane and illustrating a prior art vibration sensor device attached to the window pane.

FIG. 1 illustrates a prior art vibration sensor device 6 which is attached to a window pane 7 adjacent a window frame 8. Electric conductor leads 9 extend from the sensor device 6 toward a burglar alarm control unit, not shown. Due to the fact that the vibration sensor device 6 is not pleasant in appearance, the sensor device is attached to the window pane 7 adjacent the window frame 8. Thus, the sensor device 6 may be obscured from direct view by window curtains or the like. However, due to the fact that the vibration sensor device 6 is positioned near the window frame 8, the sensor device 6 may have limited sensitivity to breakage of the window pane 7, particularly breakage at a portion remote from the sensor device 6.

As seen in FIG. 21 a vibration or motion sensor device of this invention comprises a disc 10, which is preferably translucent and which is preferably of a rigid material, such as plastics, glass, or the like. The disc 10 is preferably one which is adapted to have sunlight flow therethrough, enhancing the various colors and configurations within the disc 10. The disc 10 is shown herein as being round. However, the disc 10 may be any other desired shape.

The disc 10 has a rear surface 10*a* (FIG. 4) to which is attached a plurality of connection pads 14 which are adapted to be adhesively attached to a window pane 20. The disc 10 has a front surface 10*b* (FIG. 3), which is shown as being irregular, as artistic configurations are formed thereupon. The configurations and other portions of the surfaces 10*a* and 10*b* may be of various colors. Thus, the disc 10 is an ornamental member attached to the window pane 20.

Figure 3:
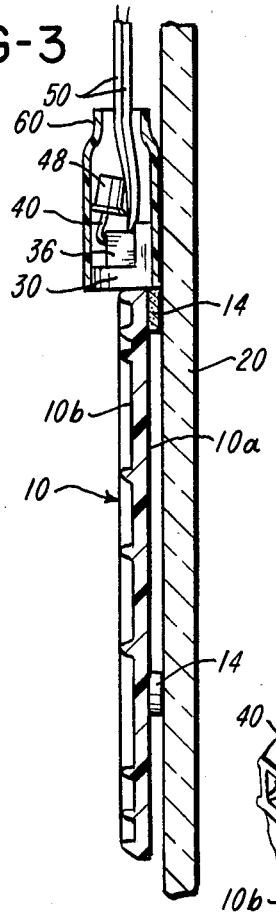
FIG. 3 is an enlarged sectional view taken substantially on line 3—3 of FIG. 2.
Figure 5:
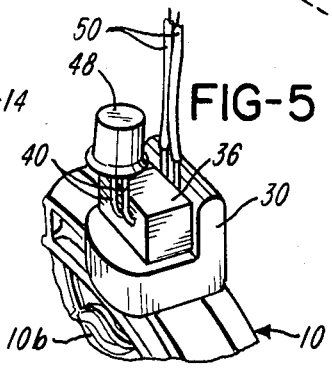
FIG. 5 is a fragmentary perspective view showing a vibration or motion sensor switch device of this invention and a portion of a support disc to which the sensor switch device is attached in accordance with this invention.

Shown at the upper portion of the disc 10 and attached thereto is a bracket 30, as shown in FIGS. 3 and 5. Mounted upon the bracket 30 is a socket 36. Rigid electric conductor wires 40 are removably but firmly retained within the socket 36 and support an electric switch housing 48, within which is a switch, not shown. The switch is electrically joined to the electric conductor wires 40 and may be of any suitable inertial type, such as a mercury switch, or the like, which senses vibration or sudden movement. Preferably, the switch within the housing 48 is a normally-closed switch. Flexible leads or conductors 50 are also attached to the socket 36 and extend to an alarm control unit, not shown.

Figure 2:
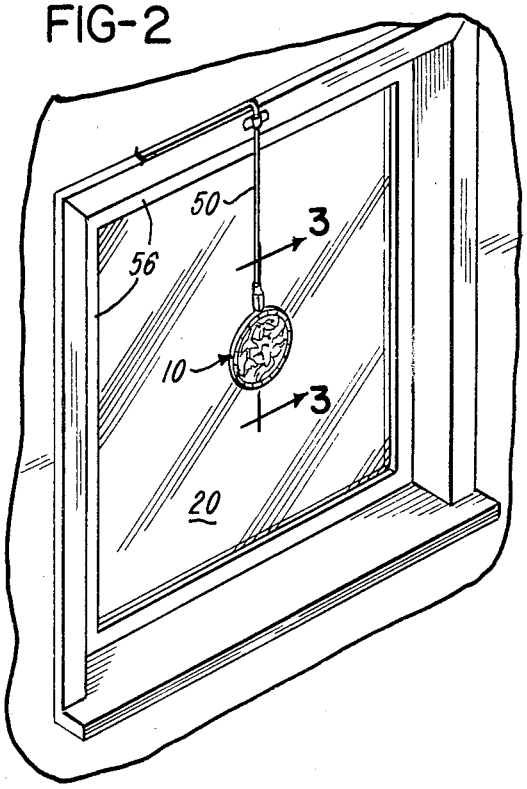
FIG. 2 is a perspective view, similar to FIG. 1, but showing a vibration or motion sensor device of this invention attached to a window pane.

The flexible electric conductors 50 are shown extending upwardly from the bracket 30 and the socket 36. As shown in FIG. 2, the flexible conductors 50 may extend along a window frame 56 toward the alarm control unit.

Figure 4:
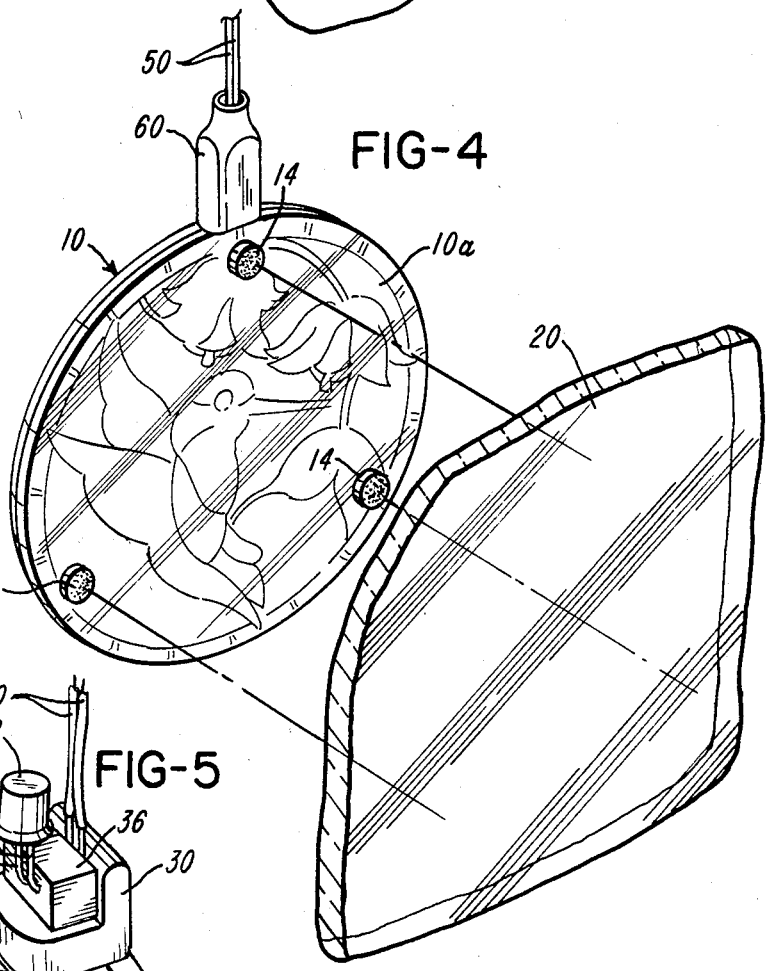
FIG. 4 is a fragmentary exploded perspective view, drawn on substantially the same scale as FIG. 3, illustrating a vibration or motion sensor device of this invention and its attachment to a window pane.

A cover member 60 is shown in FIGS. 3 and 4 enclosing the bracket 30, the base 36, and the switch housing 48.

If the window pane 20 is broken in any portion thereof or if the window pane 20 is excessively vibrated by a burglar attempting to gain entrance through the window, the switch within the switch housing 48 senses such motion, and a signal is transmitted through the electric conductors 50 to the alarm control unit, and an alarm is activated.

Thus, the vibration sensor device of this invention is an ornamental item which is attractive and which is readily adapted to be positioned at the central portion of a window pane. As the vibration sensor device is positioned at the central portion of a window pane, the device is much more sensitive to any vibration of the window pane 20 than if positioned adjacent the window frame 56.

Due to the fact that the vibration sensor device of this invention is ornamental in appearance, people who observe the vibration sensor device may not recognize the device as a part of the burglar alarm system.

Switch housings 48 which have switches of various degrees of sensitivity can be interchangably mounted upon the socket 36, to provide greater or lesser sensitivity, as required in a given location.

Although the preferred embodiment of the ornamental vibration sensor device of this invention has been described, it will be understood that within the purview of this invention various changes may be made in the form, details, proportion and arrangement of parts, the combination thereof, and the mode of operation, which generally stated consist in a sensor device within the scope of the appended claims.

The invention having thus been described, the following is claimed:

1. A motion sensor device in a burglar alarm system in which a window pane is involved comprising: a translucent ornamental disc, attachment means carried by the translucent ornamental disc for attachment of the translucent ornamental disc to a window pane, a motion sensing switch member, and means attaching the motion sensing switch member to the ornamental disc for operation of the motion sensing switch member with movement of the ornamental disc and with movement of a portion of the window pane, the means attaching the motion sensing switch member to the ornamental disc including a housing enclosing the motion sensing switch member, a bracket attached to the disc, an electrical socket attached to the bracket, and rigid electric conductor means removably connected within the socket and extending from the socket and supporting the housing, the electrical conductor means being electrically connected to the motion sensing switch member.

* * * * *

UNITED STATES PATENT AND TRADEMARK OFFICE

CERTIFICATE OF CORRECTION

PATENT NO. : 4,559,528

DATED : December 17, 1985

INVENTOR(S) : Jeffrey J. Davis

It is certified that error appears in the above-identified patent and that said Letters Patent are hereby corrected as shown below:

Column 2, line 39, change "FIG. 21" to---FIG. 2---.

Signed and Sealed this

Twenty-eighth Day of October, 1986

[SEAL]

*Attest:*

DONALD J. QUIGG

*Attesting Officer* *Commissioner of Patents and Trademarks*